United States Patent [19]

Kasprzak

[11] Patent Number: 4,685,930

[45] Date of Patent: Aug. 11, 1987

[54] METHOD FOR CLEANING TEXTILES WITH CYCLIC SILOXANES

[75] Inventor: Kenneth A. Kasprzak, Saginaw Township, Mich.

[73] Assignee: Dow Corning Corporation, Midland, Mich.

[21] Appl. No.: 835,441

[22] Filed: Feb. 27, 1986

Related U.S. Application Data

[63] Continuation of Ser. No. 670,195, Nov. 13, 1984, abandoned.

[51] Int. Cl.[4] ..... C11D 3/44; C11D 7/50; D06L 1/02; D06L 1/04

[52] U.S. Cl. ..... 8/139.1; 8/142; 8/DIG. 1; 252/8.8; 252/153; 252/154; 252/155; 252/162; 252/171; 252/174.15; 252/174.21; 252/174.25; 252/547; 252/DIG. 19

[58] Field of Search ..... 134/38; 252/153, 162, 252/174.15, 174.21, 174.25, 155, 154, 547; 8/139.1, 142

[56] References Cited

U.S. PATENT DOCUMENTS

| | | | |
|---|---|---|---|
| 3,910,848 | 10/1975 | Froehlich | 252/90 |
| 4,306,990 | 12/1981 | Goodman | 252/174.15 |
| 4,324,595 | 4/1982 | Kasprzak | 134/38 |
| 4,337,166 | 6/1982 | Hill | 252/174.15 |
| 4,501,682 | 2/1985 | Goodman | 252/174.15 |

OTHER PUBLICATIONS

Moore, A. C. "How to Clean Everything", published by Simon & Schuster, New York, 1952, p. 200.

Randlett, J. C. & Nicklaw, W. J.: *Spotting,* published by Natl. Institute of Dry Cleaning, Silver Spring, Md., 1956, p. 81.

Schuelke, A. F., Editor: Modern Spotting, published by The Reuben H. Donnelley Corp., 1961, pp. 77 & 78.

*Primary Examiner*—Dennis L. Albrecht

*Attorney, Agent, or Firm*—Alexander Weitz

[57] ABSTRACT

A method is disclosed for cleaning textiles using cyclic dimethylsiloxanes as a cleaning fluid for removing soil spots. The useful siloxanes include octamethylcyclotetrasiloxane, decamethylcyclopentasiloxane, and dodecamethylcyclohexasiloxane.

9 Claims, No Drawings

METHOD FOR CLEANING TEXTILES WITH CYCLIC SILOXANES

This is a continuation of co-pending application Ser. No. 670,195, filed on Nov. 13, 1984 now abandoned.

BACKGROUND OF THE INVENTION

The present invention relates to a method for removing soil from textiles using cyclic dimethylpolysiloxanes. In particular, this invention relates to the use of cyclic dimethylpolysiloxanes for removal of oily/greasy stains from textiles.

Textile products such as fabrics, carpets and upholstery often develop prominent stain spots from inadvertent contact with foodstuff and other materials containing grease and oils. Various organic solvents such as alcohols, petroleum hydrocarbons, and chlorinated hydrocarbons have been used in cleaning compositions adapted for direct application to fabric as spot removers.

Several approaches to formulating spot cleaning compositions are known. For instance, nonresidue cleaners are formulated with volatile components only. After dissolving, mobilizing, and removing the stained material, such formulations are intended to completely evaporate leaving no residue components on the textile. Other cleaning compositions employ a combination of solvent and solid, absorbent particles. The solvent mobilizes the soil and the absorbent solid attracts the soil and solvent to itself. The residue of absorbent solid is intended to be easily removed from the textile by brushing or vacuuming. Yet another approach involves liquid detergent compositions which have been adapted as prewash spot removers. These compositions usually contain concentrated synthetic surfactants with alcohol or other solvents. When used as a prewash spot remover, the nonvolatile surfactant components remain on the textile as a residue which is removed by a conventional home laundry operation. In the aqueous wash, the prewash spot remover composition additionally functions in the manner of a heavy-duty laundry detergent.

While known spot cleaning compositions effectively remove some stains, other types of stains may be unaffected or only incompletely removed by the compositions. In other cases, the cleaning composition itself may damage or leave a residue on the textile in such a way that a visible ring occurs around the treated area. It is an object of the present invention to reduce the problems associated with the prior art cleaning compositions by providing a new method of cleaning stains using volatile silicone fluids that effectively mobilize oil and grease stains, are nondamaging to a wide range of textiles both synthetic and natural, and leave no residue or visible ring on treated textiles.

It is known from U.S. Pat. No. 4,324,595, to remove tacky adhesives from substrates by using octamethylcyclotetrasiloxane fluid to detackify the adhered adhesive. The process is taught to be particularly useful for removing tacky adhesives from human skin, but it is also indicated that the process is applicable to removing tacky adhesives from a wide range of substrates including textiles. However, this patent teaches the removal of only tacky adhesives, it does not suggest removing oil and grease stains with cyclic dimethylsiloxanes.

Stain removing compositions are disclosed in Japanese Patent Publication Kokai No. (1974)-35681, which contain small amounts (0.5 to 10 weight percent) of silicone oil combined with cleaning solvents such as trichlorethane and petroleum hydrocarbons. Although the type of silicone oil employed is not further identified, it is taught that the silicone remains on the fabric after cleaning to provide continuing water repellency and soil resistance for the fabric. Consequently, it is apparent that this publication does not contemplate the use of completely volatile cyclic dimethylpolysiloxanes.

An aerosol type aqueous cleaning composition is disclosed in Japanese Patent Publication Kokai No. (1978)-56203, which contains nonionic surfactant, alkanolamine, glycol ether, alcohol, propellant, and 0.02 to 0.1 weight percent of linear dimethylpolysiloxane with 2 to 7 silicon atoms per molecule. This publication discloses only the use of very low amounts of linear dimethylpolysiloxanes and does not contemplate the use of larger, solvent-effective amounts of the cyclic dimethylpolysiloxanes.

The use of tetraethoxysilane as a solvent for removing grease from textiles is disclosed in Russian Patent Publication 979548-A. However, tetraethoxysilane is not stable in contact with water and may hydrolyze forming alcohol and silica solids.

A process for dry cleaning and waterproofing of fabrics is disclosed in U.S. Pat. No. 3,123,494 which process employs a silicone composition diluted in typical dry cleaning solvents. The silicone compositions recommended are mixtures of linear dimethylpolysiloxane fluids and crosslinked methylsiloxane resins. Excess liquid cleaning mixture is removed from the textiles by centrifuging but retained silicone provided a continuing waterproofing effect on the textile. Again, it is apparent that this publication does not contemplate the use of completely volatile cyclic dimethylpolysiloxanes as a cleaning solvent.

Liquid cleaning compositions for removing dirt and grit from solid surfaces are disclosed in U.S. Pat. No. 2,955,047. The compositions contain surfactants, water, water-miscible organic solvent, and an oil-in-water emulsion of dimethylpolysiloxane oil. The specified siloxanes are linear polymers with viscosities in the range of 200 to 350 centistokes. The siloxane polymer is said to impart a high glossy polish to the treated surfaces by depositing a monomolecular film on the surface. Somewhat similarly, U.S. Pat. No. 2,993,866 teaches an aerosol glass cleaner composition containing isopropanol, fluorochlorohydrocarbon propellants, and linear dimethylpolysiloxane having a viscosity of about 200 centistokes.

An all purpose cleaner composition containing a mixture of surfactants, isopropyl alcohol, and a silicone defoaming agent is disclosed in U.S. Pat. No. 4,311,608. The silicone defoaming agent is an oil-in-water emulsion of dimethylsiloxane polymer.

A cleaner (apparently a wiper type) impregnated with a composition containing mineral oils or alcohols with organopolysiloxanes is disclosed in Japanese Patent Publication Kokai No. (1975)-161059. The organopolysiloxanes are characterized by having a viscosity of not more than 30 centipoise at 20° C.

SUMMARY OF THE INVENTION

This invention concerns a method for cleaning textiles which comprises applying to a soiled textile a liquid composition containing an effective amount to aid soil removal of a cyclic siloxane selected from the group consisting of octamethylcyclotetrasiloxane, decamethylcyclopentasiloxane, and dodecamethylcyclohexasiloxane and removing from the textile a combination of soil and cyclic siloxane.

In use, the novel textile cleaning compositions are applied to a soiled area of clothing, carpet, or other textile by spraying, pouring, or from a cloth or sponge applicator. The composition may be rubbed or brushed into the textile to facilitate loosening and dissolving the soil components. The soil-solvent combination is then removed from the textile by any of the well known methods such as blotting with absorbent material, absorption unto particulate material followed by vacuuming, or a conventional home laundry operation.

DETAILED DESCRIPTION OF THE INVENTION

The cyclic siloxanes employed in the liquid cleaning and spot removing compositions of this invention are available commercially and are made by well known methods such as, for example, the hydrolysis and condensation of dimethyldichlorosilane.

Compared with the linear polydimethylsiloxanes the cyclic siloxanes employed according to this invention are relatively volatile materials having boiling points below about 250° C. at 760 mm Hg. A single cyclic siloxane may be used in the liquid cleaning composition or any mixture of two or more of the cyclic siloxanes may be used. Specifically preferred cyclic siloxanes for use in this invention are octamethylcyclotetrasiloxane, decamethylcyclopentasiloxane, and dodecamethylcyclohexasiloxane. It should be understood that useful cyclic siloxane mixtures may contain, in addition to the preferred cyclic siloxanes, minor amounts of other cyclic siloxanes including hexamethylcyclotrisiloxane or higher cyclics such as tetradecamethylcycloheptasiloxane. Generally the amount of these other cyclic siloxanes in useful cyclic siloxane mixtures will be less than about 10 percent based on the total weight of the mixture.

The amount of cyclic siloxane used in the liquid cleaning compositions of this invention is not critical so long as the amount used is effective to aid soil removal from textiles. In general, the cleaning composition may contain, for example, from 1 to 100 percent by weight of the cyclic siloxanes. It is preferred that the cleaning composition contain from 5 to 100, or more preferably 10 to 100, percent by weight of the cyclic siloxanes.

Other adjuvants may be included in the liquid cleaning compositions of this invention such as conventional cleaning solvents, absorbent solid particulate materials, synthetic builders, water soluble organic detergent compounds, and cationic antistatic substances.

For example, nonresidue spot cleaning compositions may contain conventional cleaning solvents mixed with cyclic siloxanes according to the present invention. Any conventional cleaning solvent having a boiling point below about 250° C. can be mixed with the cyclic siloxanes to prepare a liquid composition useful in the present invention. Useful additional cleaning solvents include alcohols such as isopropanol and butanol, petroleum hydrocarbons such as mineral spirits, and chlorinated hydrocarbons such as methylene dichloride, tetrachloroethylene, and trichloroethylene. Surprisingly, it has been found that a mixture of cyclic siloxane and conventional cleaning solvent is more effective at mobilizing stains than is either the cyclic siloxane or the conventional solvent alone. Mixtures of cyclic siloxanes and conventional solvents selected from the group consisting of petroleum hydrocarbons and chlorinated hydrocarbons are especially effective. Mixtures containing about 30 to 70 percent by weight of conventional cleaning solvent and 30 to 70 percent by weight of the cyclic siloxane are preferred because of their superior ability to mobilize stains.

Cleaning compositions of the solvent/absorbent class are also useful in the method of this invention. Such cleaning compositions may contain in addition to the cyclic siloxane any of the absorbent materials known for such applications. Useful absorbent materials include mineral particulates such as silica, talc, diatomaceous earth, kaolinite; organic particulates such as starch and modified starch, nut shell flour, and ground rice hulls; and synthetic porous polymers such as the urea-formaldehyde polymer particles described in U.S. Pat. No. 3,910,848, which is hereby incorporated by reference to more fully describe the polymer particles. The absorbent material is generally used in amounts of about 5 to 40 percent based on the weight of cleaning solvent in the composition.

Cleaning compositions of the solvent/absorbent class may also include a cationic antistatic agent to facilitate the removal of the particulate material during brushing or vacuuming of the textile material. Useful cationic antistats include quaternary nitrogen salts that contain at least one $C_{10}$ to $C_{24}$ aliphatic hydrocarbon substituent on the nitrogen such as stearyltrimethylammonium chloride. Antistatic agents are typically employed in amounts of about 0.1 to 3 percent by weight based on the total weight of the cleaning composition.

The method for cleaning textiles of this invention also includes the use of prewash spot remover compositions containing nonvolatile surfactant components in addition to cyclic siloxane solvent. Such prewash spot remover compositions will generally include a water soluble organic detergent material and synthetic builders in combination with the cyclic siloxane solvent. Detergent compounds useful in prewash spot removers are the anionic, nonionic, zwitterionic and ampholytic surfactant compounds. Such detergent compounds are well known to those skilled in the detergent art. Exemplary detergents are described in the well-known books entitled "Surface Active Agents" by Schwartz and Perry and "Surface Active Agents and Detergents" by Schwartz, Perry and Berch, both by Interscience Publishers, New York, N.Y., the disclosures of which are incorporated by reference herein.

Especially preferred detergents are the nonionic surfactants which are condensation products of polyethylene oxide with an organic hydrophobic compound which is usually aliphatic or alkylaromatic in nature. Exemplary nonionic surfactants are polyethylene oxide condensates of nonyl phenol and polyethylene oxide condensates of myristyl alcohol.

Generally, from about 10 to 80 percent by weight of surfactants may be used in the prewash spot removing compositions of this invention. More preferred prewash spot removing compositions contain 30 to 70 percent by weight of nonionic surfactants.

Prewash spot removers of this invention may also contain a variety of builder compounds such as sodium tripolyphosphate, sodium carbonate, sodium silicate, the alkali metal, ammonium and substituted ammonium salts of oxydisuccinic acid, oxydiacetic acid, carboxymethyloxymalonic acid, carboxymethyloxysuccinic acid, lactoxysuccinic acid, citric acid, mellitic acid, tetrahydrofurantetracarboxylic acid, polyacrylic acid, nitrilotriacetic acid, oxidized starches and mixtures thereof. Builders are generally added to prewash spot removing compositions in amounts ranging from 0 to about 50 percent by weight based on the weight of the total composition.

The liquid compositions of the present invention are especially adapted for direct application to stains and soils on fabrics and other textiles. The compositions can be applied to soiled textiles by any of the commonly used methods. The liquid compositions may be poured or sprayed onto the stains. Alternatively the composition may be brushed or rubbed onto the stained or soiled area using absorbent items such as brushes, paper towels, cloth or sponges that contain the cleaning composition.

Once the cleaning composition has been applied to the soiled textile, the cyclic siloxane acts to dissolve and/or loosen the soil which it contacts. The mobilized soil is then more easily removed from the textile in combination with the cyclic siloxane. The cyclic siloxane/soil combination can be removed from the textile by any convenient method such as blotting the textile with a dry absorbent material. The textile may be blotted, for example, with sponges, paper towels, or cloth towels. Alternatively, the soil/cyclic siloxane combination may be removed by processes such as brushing, vacuuming, or conventional home laundry operations. Brushing and vacuuming are especially useful if solid, absorbent particles are employed in the liquid cleaning composition. Conventional home laundry is the preferred method of removal when nonvolatile surfactants are used in combination with cyclic siloxane in the cleaning composition.

The cyclic siloxanes are sufficiently volatile that any residual cyclic siloxane on the textile, after removal of the soil, readily volatilizes to leave the treated area dry as well as clean.

The method of the present invention can be used to remove a wide variety of soils and stains. The cyclic siloxane is especially effective at removing oil and grease spots or stains. One special advantage of the cyclic siloxanes as cleaning solvents is that the formation of a secondary stain ring is either eliminated or greatly reduced in definition. Another advantage is that the cyclic siloxanes are essentially nontoxic and nonharmful in the environment.

Furthermore, the cyclic siloxanes can be used with a wide variety of fabrics without harming or in any way changing the appearance of the fabric. The method of cleaning of this invention can be used on all types of textiles including carpets and fabrics used for clothing or upholstery.

The following examples are presented to illustrate the invention, but the examples in no way limit the scope of the invention as more fully set out in the claims.

Artificial sebum employed in the following examples was prepared from a base mixture of palmitic acid (5 g), stearic acid (2.5 g), coconut oil (7.5 g), paraffin (5 g), spermaceti (7.5 g), olive oil (10 g), squalene (2.5 g), cholesterol (2.5 g), oleic acid (5 g), and linoleic acid (2.5 g). A melted (120° F.) 5 g portion of the base mixture was combined with oleic acid (4 g) and triethanolamine (8 g) and agitated at 120° F. until homogenous. Then air filter dirt (12 g, +200 mesh) and deionized water (100 ml) were added and the mixture agitated for ten minutes. Additional deionized water (900 ml) was added and the mixture was agitated in a homogenizer for ten minutes. The mixture was stored in a 100° F. oven and shaken well before using for staining.

EXAMPLE 1

The following experiments demonstrate the stain removal ability of cyclic dimethylpolysiloxanes on 100 percent cotton fabric.

Cotton fabric test pieces were prepared with approximately 1 inch diameter stains of used motor oil, cooking oil and artificial sebum. The stains were aged at room temperature for 24 hours. Stains were cleaned by placing the fabric pieces on several absorbent paper towels and rubbing the stained area for 20 seconds with a paper towel saturated with the cleaning fluid.

The cyclic siloxane fluids tested were (A) octamethylcyclotetrasiloxane, (B) decamethylcyclopentasiloxane, (C) a cyclic siloxane mixture of about 91 percent by weight octamethylcyclotetrasiloxane and about 8 percent by weight decamethylcyclopentasiloxane, and (D) a cyclic siloxane mixture of about 1.3 percent by weight octamethylcyclotetrasiloxane, about 69.3 percent by weight decamethylcyclopentasiloxane and about 29.1 percent by weight dodecamethylcyclohexasiloxane. For comparison, hexamethyldisiloxane, mineral spirits, tetrachloroethylene, isopropyl alcohol, and xylene were also used to clean the stains.

After drying, the cleaned fabric pieces were rated visually for the degree of stain removal according to the following scale:

5=Complete removal
4=Slight remaining stain
3=Moderate stain remaining
2=Slight removal of stain
1=No change in stain The ratings were made by comparison of the test pieces with a standard series of exemplary stains in a black box using a fluorescent light source. Deviations between the test pieces and the standard stains are indicated by fractional ratings.

The used motor oil tended to form a dual stain containing a smaller sludge portion nearer the center and a larger oil portion which spread out more from the point of application. Some differences in the cleaning of the two portions of these stains were observed and consequently the cleaning of each portion was separately rated. The results of the visual rating are presented in Table 1.

TABLE 1

STAIN REMOVAL ON COTTON FABRIC

| | Stain | | | |
|---|---|---|---|---|
| Cleaning Fluid | Motor Oil (Sludge) | Motor Oil | Cooking Oil | Artificial Sebum |
| A | 2.5 | 2.0 | 5.0 | 3.0 |
| B | 2.5 | 2.0 | 5.0 | 3.0 |
| C | 2.9 | 2.0 | 4.8 | 2.8 |
| D | 2.8 | 2.5 | 5.0 | 3.0 |
| $[(CH_3)_3Si]_2O$ | 2.7 | 2.9 | 4.3 | 3.0 |
| Mineral Spirits | 2.9 | 2.5 | 4.9 | 3.0 |
| Tetrachloroethylene | 2.5 | 2.5 | 5.0 | 2.8 |
| Isopropyl Alcohol | 1.0 | 1.0 | 4.5 | 1.0 |
| Xylene | 2.8 | 3.5 | 5.0 | 1.0 |

EXAMPLE 2

The stain removal testing procedure of Example 1 was repeated using a 65/35 polyester/cotton fabric. The results of the black box visual ratings of the cleaned fabric are presented in Table 2.

TABLE 2

STAIN REMOVAL ON 65/35 POLYESTER/COTTON FABRIC

| Cleaning Fluid | Stain: Motor Oil (Sludge) | Motor Oil | Cooking Oil | Artificial Sebum |
|---|---|---|---|---|
| A | 2.5 | 3.0 | 5.0 | 3.0 |
| B | 3.0 | 3.0 | 5.0 | 3.0 |
| C | 2.9 | 3.0 | 5.0 | 3.0 |
| D | 3.5 | 3.5 | 5.0 | 3.0 |
| $[(CH_3)_3Si]_2O$ | 2.9 | — | — | 3.0 |
| Isopropyl Alcohol | 1.0 | 1.0 | 3.0 | 3.0 |
| Xylene | 3.0 | 4.0 | 5.0 | 3.0 |

EXAMPLE 3

The stain removal testing procedure of Example 1 was repeated using a 100 percent polyester fabric. The results of the black box visual ratings of the cleaned fabric are presented in Table 3.

TABLE 3

STAIN REMOVAL ON 100% POLYESTER FABRIC

| Cleaning Fluid | Stain: Motor Oil (Sludge) | Motor Oil | Cooking Oil | Artificial Sebum |
|---|---|---|---|---|
| A | 2.0 | 5.0 | 5.0 | 1.0 |
| B | 2.0 | 5.0 | 5.0 | 1.0 |
| C | 2.0 | 5.0 | 5.0 | 1.0 |
| D | 2.0 | 5.0 | 5.0 | 1.0 |
| $[(CH_3)_3Si]_2O$ | 1.5 | 5.0 | 4.2 | 1.0 |
| Mineral Spirits | 3.0 | 5.0 | 4.1 | 1.0 |
| Tetrachloroethylene | 3.5 | 5.0 | 4.9 | 1.0 |

EXAMPLE 4

The stain removal testing procedure of Example 1 was modified by heat setting the stain before cleaning. Stains were set by placing the fabric in an automatic clothes dryer at the high temperature setting for two cycles of 60 minutes each. Polyester (100%) fabric was used in these tests. Results of the black box visual ratings of cleaned fabric are presented in Table 4.

TABLE 4

STAIN REMOVAL OF HEAT SET STAINS

| Cleaning Fluid | Stain: Motor Oil (Sludge) | Motor Oil | Cooking Oil | Artificial Sebum |
|---|---|---|---|---|
| A | 2.0 | 5.0 | 5.0 | 1.3 |
| B | 2.0 | 5.0 | 4.9 | 1.6 |
| C | 2.0 | 5.0 | 5.0 | 1.0 |
| D | 2.0 | 5.0 | 4.7 | 1.2 |
| $[(CH_3)_3Si]_2O$ | 2.0 | 5.0 | 4.8 | 1.2 |
| Mineral Spirits | 3.0 | 5.0 | 4.8 | 1.2 |
| Tetrachloroethylene | 3.5 | 4.9 | 5.0 | 1.0 |

EXAMPLE 5

The following experiments demonstrate the relative efficiency of cyclic dimethylpolysiloxanes in spreading oil stains on fabric. The degree of spreading of the stain relates to the extent of mobilization of the stain by the solvent being tested. Generally, the more effectively a stain can be mobilized, the more easily and completely it can be removed from the fabric.

Cotton fabric test pieces (8 inch × 8 inch) were placed in an embroidery hoop and approximately 1 ml of cooking oil was applied to the center of the fabric. Stains were aged at room temperature for 24 hours. The fabric was then positioned under a burette filled with the cleaning fluid. With the burette tip just above the center of the stain, a 0.5 ml portion of the cleaning fluid was dropped on the stain. The fabric was allowed to dry at room temperature and the size of the resulting stain was measured. Generally the stains were circular or slightly oval in shape. The approximate areas of the stains after the spreading process with various cleaning fluids are shown in Table 5. In the case of oval shaped stains, approximate areas were calculated as if the stain were circular using a diameter equal to the average of the length and width of the oval. The cyclic siloxane fluids tested are described in Example 1.

TABLE 5

SPREADING OF COOKING OIL STAINS ON COTTON

| Cleaning Fluid | Stain Area (sq. in.) |
|---|---|
| None | 0.8 |
| A | >50 |
| B | >50 |
| C | >50 |
| D | 26 |
| $[(CH_3)_3Si]_2O$ | 5.9 |
| Mineral Spirits | >50 |
| Tetrachloroethylene | 4.9 |

EXAMPLE 6

The stain spreading procedure of Example 5 was repeated using 100% polyester fabric test pieces. The approximate stain areas after spreading are shown in Table 6.

TABLE 6

SPREADING OF COOKING OIL STAINS ON POLYESTER

| Cleaning Fluid | Stain Area (sq. in.) |
|---|---|
| None | 0.8 |
| A | 16 |
| B | 16 |
| C | 19 |
| D | 22 |
| $[(CH_3)_3Si]_2O$ | 13 |
| Mineral Spirits | 25 |
| Tetrachloroethylene | 16 |

EXAMPLE 7

The stain spreading procedure of Example 5 was repeated using a 65/35 polyester/cotton fabric. Approximate stain areas after spreading are presented in Table 7.

TABLE 7

SPREADING OF COOKING OIL STAINS ON 65/35 POLYESTER/COTTON

| Cleaning Fluid | Stain Area (sq. in.) |
|---|---|
| None | 0.8 |
| A | 33 |
| B | 33 |
| C | 33 |
| D | 33 |
| $[(CH_3)_3Si]_2O$ | 27 |
| Mineral Spirits | 38 |

TABLE 7-continued

| SPREADING OF COOKING OIL STAINS ON 65/35 POLYESTER/COTTON | |
|---|---|
| Cleaning Fluid | Stain Area (sq. in.) |
| Tetrachloroethylene | 5.9 |

EXAMPLE 8

The following experiments demonstrate the stain spreading efficiency of blends of cyclic dimethylpolysiloxanes and conventional cleaning fluids such as mineral spirits and tetrachloroethylene.

Cooking oil stains were prepared on 65/35 polyester/cotton fabric and the spreading procedure of Example 5 was repeated except that a 1 ml portion of a blend of cleaning materials was dropped on the stain. Octamethylcyclotetrasiloxane was blended in various proportions by weight with either mineral spirits or tetrachloroethylene to prepare the cleaning materials. The approximate stain areas after spreading are shown in Table 8.

TABLE 8

| SPREADING OF STAINS WITH BLENDS OF CYCLIC SILOXANES AND CONVENTIONAL CLEANING FLUIDS | | |
|---|---|---|
| Conventional Cleaning Fluid in Blend | Ratio of Cyclic Siloxane to Conventional Fluid | Stain Area (sq. in.) |
| Mineral Spirits | 5/95 | 40 |
| Mineral Spirits | 10/90 | 39 |
| Mineral Spirits | 20/80 | 40 |
| Mineral Spirits | 30/70 | 47 |
| Mineral Spirits | 40/60 | >50 |
| Mineral Spirits | 50/50 | >50 |
| Mineral Spirits | 60/40 | >50 |
| Mineral Spirits | 70/30 | >50 |
| Mineral Spirits | 80/20 | 34 |
| Mineral Spirits | 90/10 | 27 |
| Tetrachloroethylene | 5/95 | 13 |
| Tetrachloroethylene | 10/90 | 17 |
| Tetrachloroethylene | 20/80 | 10 |
| Tetrachloroethylene | 30/70 | 25 |
| Tetrachloroethylene | 40/60 | >50 |
| Tetrachloroethylene | 50/50 | >50 |
| Tetrachloroethylene | 60/40 | 22 |
| Tetrachloroethylene | 70/30 | >50 |
| Tetrachloroethylene | 80/20 | 22 |
| Tetrachloroethylene | 90/10 | 31 |

EXAMPLE 9

The stain spreading procedure of Example 8 was repeated using decamethylcyclopentasiloxane blended in various proportions by weight with either mineral spirits or tetrachloroethylene. The approximate stain areas after spreading are presented in Table 9.

TABLE 9

| SPREADING OF STAINS WITH BLENDS OF CYCLIC SILOXANE AND CONVENTIONAL CLEANING FLUIDS | | |
|---|---|---|
| Conventional Cleaning Fluid in Blend | Ratio of Cyclic Siloxane to Conventional Fluid | Stain Area (sq. in.) |
| Mineral Spirits | 5/95 | 28 |
| Mineral Spirits | 10/90 | >50 |
| Mineral Spirits | 20/80 | >50 |
| Mineral Spirits | 30/70 | 34 |
| Mineral Spirits | 40/60 | >50 |
| Mineral Spirits | 50/50 | 31 |
| Mineral Spirits | 60/40 | >50 |
| Mineral Spirits | 70/30 | 35 |
| Mineral Spirits | 80/20 | 38 |
| Mineral Spirits | 90/10 | 37 |
| Tetrachloroethylene | 5/95 | 18 |
| Tetrachloroethylene | 10/90 | 19 |

TABLE 9-continued

| SPREADING OF STAINS WITH BLENDS OF CYCLIC SILOXANE AND CONVENTIONAL CLEANING FLUIDS | | |
|---|---|---|
| Conventional Cleaning Fluid in Blend | Ratio of Cyclic Siloxane to Conventional Fluid | Stain Area (sq. in.) |
| Tetrachloroethylene | 20/80 | 25 |
| Tetrachloroethylene | 30/70 | 33 |
| Tetrachloroethylene | 40/60 | 25 |
| Tetrachloroethylene | 50/50 | 33 |
| Tetrachloroethylene | 60/40 | 31 |
| Tetrachloroethylene | 70/30 | 21 |
| Tetrachloroethylene | 80/20 | 26 |
| Tetrachloroethylene | 90/10 | 33 |

EXAMPLE 10

The following tests demonstrate the use of cyclic dimethylpolysiloxanes as a solvent component in prewash spotting formulations used in home laundering.

Polyester fabric test pieces were prepared with approximately 1 inch diameter stains of used motor oil, cooking oil, and artificial sebum. Stains were heat set by placing the fabric in an automatic clothes dryer at the high temperature setting for two cycles of 60 minutes each. Each stain was treated with 2 ml of the test fluid as described in Example 1. Each fluid was left on the stain for one to two minutes. The test fabric pieces were then washed in a household automatic washer on the normal setting using the recommended level of a powdered nonphosphate detergent. The fabric pieces were dried in an automatic clothes dryer on the permanent press setting.

The cleaned fabric pieces were rated visually for the degree of stain removal according to the following scale:

5=Complete removal
4=Slight remaining stain
3=Moderate stain remaining
2=Slight removal of stain
1=No change in stain The ratings were made by comparison of the test pieces with a standard series of exemplary stains in a black box using a fluorescent light source.

The used motor oil tended to form a dual stain containing a smaller sludge portion nearer the center and a larger oil portion which spread out more from the point of application. Some differences in the cleaning of the two portions of these stains were observed and consequently the cleaning of each portion was separately rated. The results of the visual rating are presented in Table 10.

TABLE 10

| STAIN REMOVAL BY PREWASH SPOTTING | | | | |
|---|---|---|---|---|
| | Stain | | | |
| Solvent | Motor Oil (Sludge) | Motor Oil | Cooking Oil | Artificial Sebum |
| A | 3.0 | 5.0 | 4.5 | 5.0 |
| B | 3.5 | 5.0 | 5.0 | 5.0 |
| C | 3.0 | 5.0 | 5.0 | 5.0 |
| D | 3.0 | 5.0 | 5.0 | 5.0 |
| $[(CH_3)_3Si]_2O$ | 4.0 | 5.0 | 4.9 | 5.0 |
| Mineral Spirits | 4.0 | 5.0 | 5.0 | 5.0 |
| Tetrachloroethylene | 4.2 | 5.0 | 4.9 | 5.0 |
| Isopropyl Alcohol | 1.0 | 5.0 | 3.5 | 4.0 |
| Xylene | 3.0 | 5.0 | 5.0 | 3.3 |
| Polydimethylsiloxane 2 cs* | 1.2 | 5.0 | 5.0 | 3.7 |
| Polydimethylsiloxane | 1.0 | 5.0 | 5.0 | 3.5 |

TABLE 10-continued

STAIN REMOVAL BY PREWASH SPOTTING

| Solvent | Stain | | | |
|---|---|---|---|---|
| | Motor Oil (Sludge) | Motor Oil | Cooking Oil | Artificial Sebum |
| 5 cs* Polydimethylsiloxane 10 cs* | 1.0 | 5.0 | 5.0 | 4.0 |

*Trimethylsilyl endblocked linear dimethylsiloxane polymers

That which is claimed is:

1. A method for cleaning textiles which comprises applying a liquid composition consisting essentially of about 100 percent by weight of a cyclic siloxane selected from the group consisting of octamethylcyclotetrasiloxane, decamethylcyclopentasiloxane, and dodecamethylcyclohexasiloxane to a textile soiled with oil, grease or sebum, and removing from the textile a combination comprising cyclic siloxane and oil, grease or sebum.

2. A method for cleaning textiles which comprises applying to a soiled textile a composition consisting essentially of (a) 30 to 70 percent by weight of a cyclic siloxane selected from the group consisting of octamethylcyclotetrasiloxane and decamethylcyclopentasiloxane, and (b) 30 to 70 percent by weight of tetrachloroethylene; and removing from the textile a combination comprising soil, tetrachloroethylene and cyclic siloxane.

3. A method for cleaning textiles which comprises applying to a soiled textile a composition consisting essentially of (a) 30 to 70 percent by weight of octamethylcyclotetrasiloxane, and (b) 30 to 70 percent by weight of mineral spirits; and removing from the textile a combination comprising soil, mineral spirits and cyclic siloxane.

4. A method for cleaning textiles which comprises applying to a textile soiled with oil, grease or sebum, a composition consisting essentially of (a) an absorbent material selected from the group consisting of mineral particulates, organic particulates and synthetic porous polymers, and (b) an effective amount to aid soil removal of a solvent component comprising a cyclic siloxane selected from the group consisting of octamethylcyclotetrasiloxane, decamethylcyclopentasiloxane, and dodecamethylcyclohexasiloxane, wherein said absorbent material (a) is used at a level of about 5 to 40 weight percent based on said component (b) and wherein said cyclic siloxane comprises about 100 percent of said solvent component; and removing from the textile a combination comprising oil, grease or sebum, absorbent material and cyclic siloxane.

5. The method of claim 4, wherein said composition further comprises from about 0.1 to 3 percent by weight of a cationic antistatic agent.

6. A method for cleaning textiles which comprises applying to a textile soiled with oil, grease or sebum, a composition consisting essentially of (a) a surfactant selected from the group consisting of anionic, nonionic, zwitterionic and ampholytic surfactants, and (b) an effective amount to aid soil removal of a solvent component comprising a cyclic siloxane selected from the group consisting of octamethylcyclotetrasiloxane, decamethylcyclopentasiloxane, and dodecamethylcyclohexasiloxane, wherein said surfactant constitutes from about 10 to 80 weight percent of said composition and said cyclic siloxane comprises about 100 percent of said solvent component; and removing from the textile a combination comprising oil, grease or sebum, surfactant and cyclic siloxane.

7. The method of claim 6, wherein said surfactant is of the nonionic type.

8. The method of claim 7, wherein said surfactant is a condensation product of polyethylene oxide with an organic hydrophobic compound selected from the group consisting of nonyl phenol and myristyl alcohol.

9. The method of claim 6, wherein said composition further comprises from 0 to about 50 weight percent of a detergent builder compound.

* * * * *